US010119540B2

(12) United States Patent
Zhang et al.

(10) Patent No.: US 10,119,540 B2
(45) Date of Patent: Nov. 6, 2018

(54) VARIABLE DISPLACEMENT VANE PUMP

(71) Applicant: Ford Global Technologies, LLC, Dearborn, MI (US)

(72) Inventors: Dengfu Zhang, Northville, MI (US); Robert J. Miller, Livonia, MI (US); Derek Kinch, Ypsilanti, MI (US); Mark Davis, Plymouth, MI (US); Akhter Zaman, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 257 days.

(21) Appl. No.: 14/962,019

(22) Filed: Dec. 8, 2015

(65) Prior Publication Data

US 2017/0159657 A1 Jun. 8, 2017

(51) Int. Cl.
*F04C 14/22* (2006.01)
*F04C 14/18* (2006.01)
*F04C 2/344* (2006.01)

(52) U.S. Cl.
CPC ..... *F04C 14/22* (2013.01); *F04C 2/344* (2013.01); *F04C 2240/20* (2013.01); *F04C 2240/30* (2013.01)

(58) Field of Classification Search
CPC ..... F04C 14/22; F04C 2/344; F04C 2240/20; F04C 2240/30; F04C 14/18; F04C 2/34
USPC ..... 418/27
See application file for complete search history.

(56) References Cited

U.S. PATENT DOCUMENTS

| | | | | |
|---|---|---|---|---|
| 6,579,070 | B1 | 6/2003 | Birkenmaier et al. | |
| 7,993,116 | B2 | 8/2011 | Hoshina et al. | |
| 8,403,646 | B2 | 3/2013 | Yoshinami | |
| 2008/0014108 | A1* | 1/2008 | Schneider | F04C 14/226 418/266 |
| 2008/0304961 | A1 | 12/2008 | Bhogal et al. | |
| 2011/0123379 | A1* | 5/2011 | Saga | F04C 2/3442 418/26 |

* cited by examiner

*Primary Examiner* — Phutthiwat Wongwian
*Assistant Examiner* — Kelsey Stanek
(74) *Attorney, Agent, or Firm* — James Dottavio; Brooks Kushman P.C.

(57) ABSTRACT

A sliding vane pump includes a passageway that fluidly connects one or more pumping chambers to a side chamber. The passageway pressurizes the side chamber. This fluid pressure exerts a force that counteracts the force caused by pressure differences between the outlet pumping chambers and the inlet pumping chambers. At high speed, part of the side chamber is pressurized by the smallest volume outlet pumping chamber while another portion of the side chamber is pressurized by the largest volume outlet chamber. This results in a force counteracting an uncommanded displacement decrease of the pump.

9 Claims, 4 Drawing Sheets

FIG. 1 – PRIOR ART

VARIABLE DISPLACEMENT VANE PUMP

TECHNICAL FIELD

This disclosure relates to the field of motor vehicle transmission pumps. More particularly, the disclosure pertains to a sliding pocket variable displacement vane pump.

BACKGROUND

Many vehicles are used over a wide range of vehicle speeds, including both forward and reverse movement. Some types of engines, however, are capable of operating efficiently only within a narrow range of speeds. Consequently, transmissions capable of efficiently transmitting power at a variety of speed ratios are frequently employed. When the vehicle is at low speed, the transmission is usually operated at a high speed ratio such that it multiplies the engine torque for improved acceleration. At high vehicle speed, operating the transmission at a low speed ratio permits an engine speed associated with quiet, fuel efficient cruising.

FIG. 1 illustrates a typical vehicle powertrain system 10. Mechanical power flow connections are indicates with solid bold lines, the flow of hydraulic fluid is indicated with dashed lines, and the flow of electrical information signals is indicated with dotted lines. An internal combustion engine 12 drives a crankshaft 14 which supplies input power to transmission 16. The transmission 16 adjusts the speed and torque and delivers the power to differential 18. Differential 18 divides the power between left and rights wheels 20 and 22 while allowing slight speed differences as the vehicle turns a corner.

Within transmission 16, the speed and torque are adjusted by two components, torque converter 24 and gearbox 26. Torque converter 24 includes an impeller and turbine that transmit power hydro-dynamically whenever the impeller rotates faster than the turbine. It may also include a stator that multiplies the torque. The torque converter may also include a bypass clutch that, when engaged, transmits power mechanically from the impeller to the turbine without the parasitic losses associated with hydro-dynamic power transfer. Gearbox 26 includes gearing and clutches arranged such that engaging various subsets of the clutches establish various power flow paths. The different power flow paths have different speed ratios. Gearbox 26 shifts from one speed ratio to another speed ratio by releasing some clutches and engaging other clutches to establish a different power flow path.

Torque converter 24 and gearbox 26 are controlled by adjusting the pressure of hydraulic fluid supplied to various clutches. Pump 28 is driven by the transmission input which is driven by crankshaft 14. Pump 28 draws fluid from sump 30 and supplies the fluid, at elevated pressure, to valve body 32. The quantity of fluid supplies is based on engine speed and on a parameter of the pump geometry called pump displacement. In response to signals from controller 34, valve body 32 supplies the fluid to the various clutches in torque converter 24 and gearbox 26 at controlled pressures less than the pressure supplied by pump 28. The valve body also supplies fluid to the hydro-dynamic chamber of torque converter 24 and supplies fluid for lubrication to gearbox 26. Fluid travels from gearbox 26 and valve body 32 back to the sump 30 to complete the cycle. The quantity of fluid needed varies depending on the current operating state of the transmission. In response to these changes and in response to changes in engine speed, controller 34 may also direct valve body 32 to adjust the pump displacement.

SUMMARY OF THE DISCLOSURE

A sliding vane pump includes a fixed housing, a sliding housing configured to slide within the fixed housing, and a rotor. The fixed housing defines inlet and outlet ports. The sliding housing and fixed housing define a side chamber. The sliding housing defines a cylindrical chamber within which the rotor rotates. The rotor has a plurality of vanes configured to rotate with the rotor and to seal against a wall of the cylindrical chamber to define a plurality of pumping chambers. The side chamber is fluidly connected to a first pumping chamber such that fluid pressure in the side chamber exerts a first force on the sliding housing opposing a second force on the sliding housing due to differential fluid pressures among the pumping chambers. The first pumping chamber may be fluidly connected to the side chamber by a first passageway and fluidly connected to the outlet port by a second passageway separate from the first passageway. The first pumping chamber may have the least volume of any of the plurality of pumping chambers. The side chamber may also be fluidly connected to a second pumping chamber, which may have the largest volume of any of the plurality of pumping chambers. A spring may bias the sliding housing to a position relative to the fixed housing in which a pump displacement is a maximum.

A pump includes a slider configured to slide within a housing and a rotor. The slider defines a cylindrical chamber. A plurality of vanes rotate with the rotor and seal against a wall of the cylindrical chamber to define a plurality of pumping chambers. The slider and the housing define a side chamber fluidly connected to a subset of the pumping chambers. The side chamber may be fluidly connected to the subset of pumping chambers by one or more passageways defined in the slider.

A vane pump sliding housing includes opposing top and bottom surfaces, a cylindrical inner surface, and an outer surface. The outer surface configured to position the sliding housing within an outer housing in a first direction while permitting relative motion in a second direction. The sliding housing defines a first passageway connecting the cylindrical inner surface to the outer surface. The sliding housing may also define a second passageway connecting the cylindrical inner surface to the outer surface.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
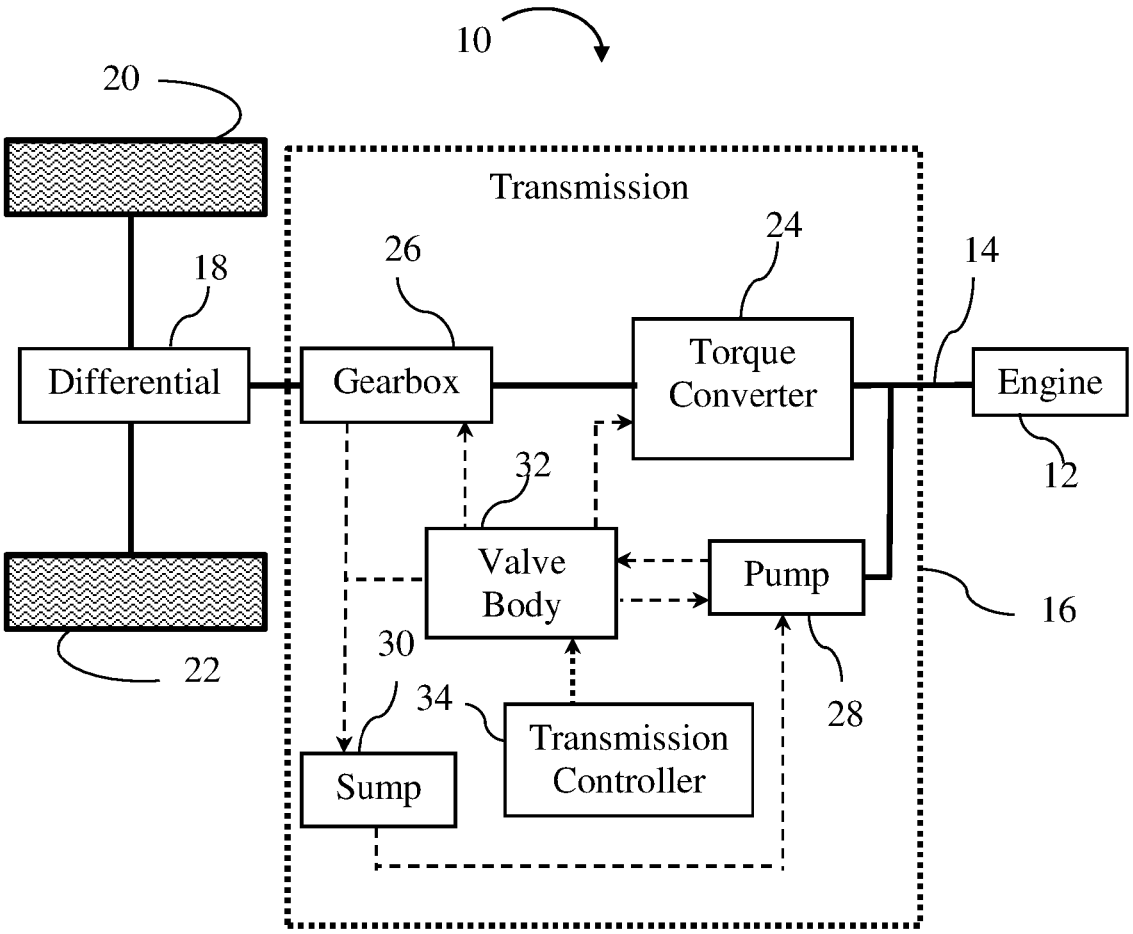
FIG. 1 is schematic diagram of a vehicle powertrain.
Figure 2:
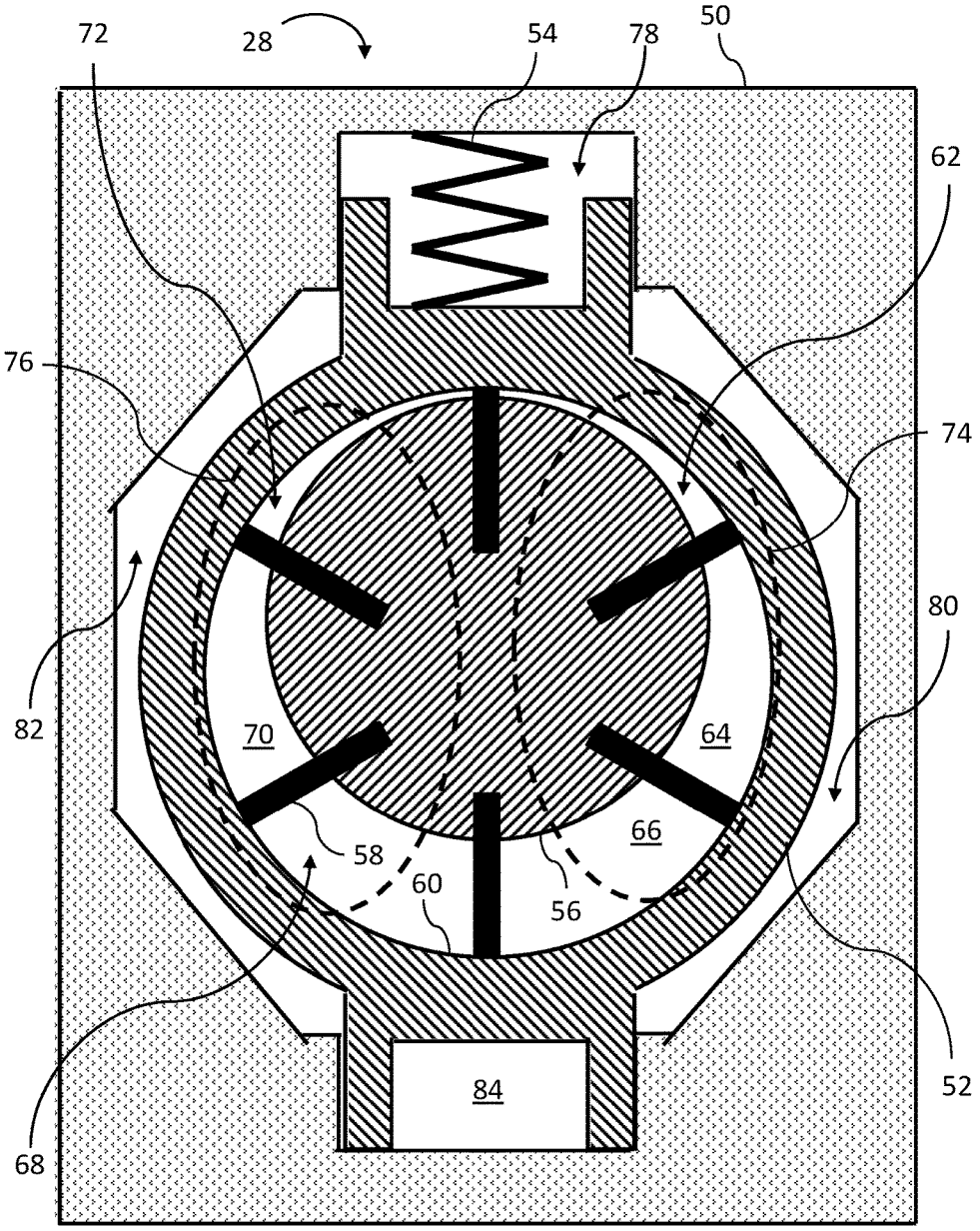
FIG. 2 is a cross section of a sliding pocket vane pump in a full displacement position.

A sliding pocket vane pump 28 is illustrated in FIG. 2. The pump includes a fixed outer housing 50 which may be integrated into a valve body housing. A sliding housing 52 fits within a chamber within outer housing 50. A spring 54 biases the sliding housing toward the full displacement position shown in FIG. 2. The sliding housing defines a circular interior chamber. A rotor 56 rotates within the circular chamber about an axis that is fixed with respect to the outer housing 50. A number of vanes 58 rotate with rotor 56 such that the tips of each rotor follow an inner surface 60 of the circular chamber of sliding housing 52. The rotor, vanes, and sliding housing collectively define a number of pumping chambers 62, 64, 66, 68, 70, and 72. The volumes of chambers 62, 64, and 66 increase as the rotor turns clockwise. An inlet port 74 is defined in the outer housing, extending above or below the plane of the cross section of FIG. 2, such that fluid is drawn from the inlet port into the expanding chambers. The volumes of chambers 68, 70, and 72, on the other hand, decrease as the rotor turns clockwise. An outlet port 76 is defined in the outer housing such that fluid is pushed into the outlet port as the chambers shrink. Fluid at controlled pressure is supplied to chambers 78, 80, 82, and 84. To command the pump to the full displacement position shown in FIG. 2, fluid at equal and low pressure is supplied to these chambers.

Figure 3:
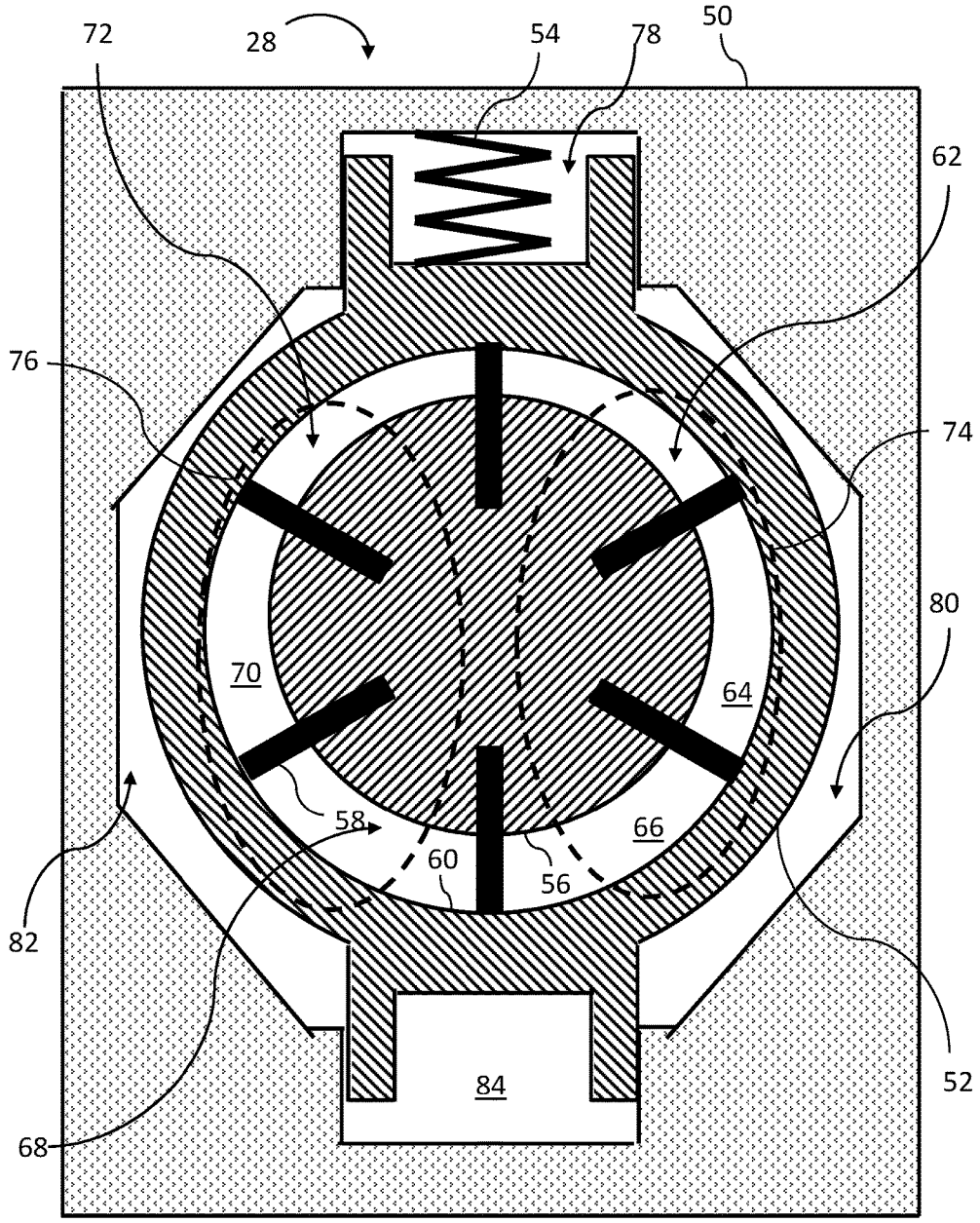
FIG. 3 is a cross section of a sliding pocket vane pump in a partial displacement position.

When the demand for fluid is low and/or the engine speed is high, pump 28 is commanded to the low displacement condition illustrated in FIG. 3 by supplying high pressure fluid to chamber 84. Chambers 78, 80, and 82 continue to be supplied with low pressure fluid, so there is a net hydraulic force pushing against spring 54. In the condition shown in FIG. 3, the volumes of pumping chambers 62, 64, and 66 continues to increase as rotor 56 turns clockwise, but by substantially less than in FIG. 2. Similarly, the volumes of pumping chambers 68, 70, and 72 increases by substantially less than in FIG. 2. Consequently, the quantity of fluid draw from inlet 74 and pushed into outlet 76 per revolution of rotor 56 is substantially less.

In addition to chambers 78, 80, 82, and 84, pumping chambers 62, 64, 66, 68, 70, and 72 also exert force on sliding housing 52. In order to push the fluid through downstream flow restrictions, the pressure in the outlet port 76 in higher than the pressure in inlet port 74. At relatively low speed, the pressure in pumping chambers 62, 64, and 66 is approximately equal to the pressure in inlet port 74 and the pressure in pumping chambers 68, 70, and 72 is approximately equal to the pressure in outlet port 76. These pressures produce a net force toward the left. This net force increases the frictional force between outer housing 50 and sliding housing 52. This frictional force tends to make the sliding housing stay in the same position when commanded to change position, making the pump unresponsive to small displacement change commands.

When the pump is rotating quickly, the pressures in chambers 68, 70, and 72 are not equal. Due to entrained air in the fluid, the fluid has non-negligible compressibility. As the chamber moves through the position occupied by chamber 68 in FIGS. 2 and 3, the percentage change in volume per degree of rotation is small. Consequently, the pressure in the chamber in that position may be less than the pressure in outlet port 76. On the other hand, the chamber in the position of chamber 72 has a large percentage decrease in volume per degree of rotation. Therefore, the pressure in higher than the pressure in outlet port 76. This effect is particularly strong when the slider is in the full displacement position of FIG. 2 and the air content of the fluid is high. The differential pressure between the chambers in these positions results in a net force biasing the sliding housing toward the low displacement position of FIG. 3. At high rotor speeds, this effect may overcome the force of spring 54 causing the displacement to decrease despite a full displacement command. If the controller had commanded full displacement in response to a high flow demand, the flow rate produced may fail to satisfy that demand.

Figure 4:
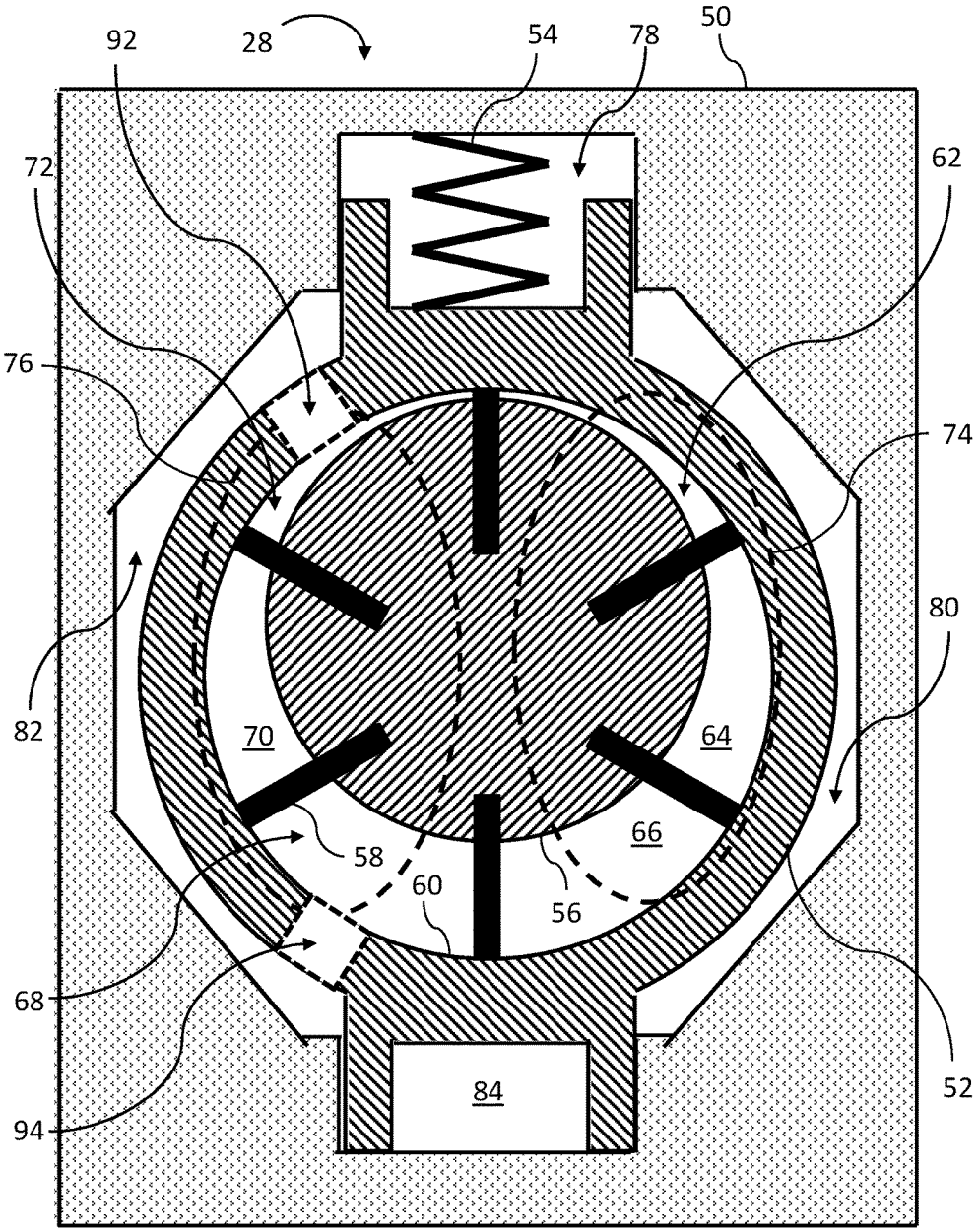
FIG. 4 is a cross section of a sliding pocket vane pump with compensation grooves.

FIG. 4 illustrates a sliding vane pump designed to avoid the high speed control issues discussed above. Two grooves 92 and 94 have been added to the sliding housing 52. Groove 92 connects the pumping chamber in the position of chamber 72 to the adjacent region of side chamber 82. A side chamber is a chamber in the same plane as the rotor but on the outside of the sliding housing. Groove 94 connects the pumping chamber in the position of chamber 68 to the adjacent region of side chamber 82. Unlike the pumps of FIGS. 2 and 3, side chamber 82 is not separately supplied with low pressure fluid from the valve body. Chambers 78 and 80 are continuously supplied with low pressure fluid. Chamber 84 is supplied with fluid at a pressure indicating the desired displacement.

At all rotor speeds, the average pressure in side chamber 82 is approximately equal to the average pressure in chambers 68, 70, and 72 such that no net side force is generated. Furthermore, at high rotor speed, the upper portion of side chamber 82 is at substantially higher pressure than the lower portion. Although some fluid will flow from the high pressure region to the low pressure region, the passage connecting these regions has sufficiently high flow resistance to maintain substantial pressure difference. The pressure gradient within side chamber 82 causes a net force on sliding housing 52 biasing it toward the full displacement position. This force counteracts the force produced by the differential pressures between chambers 68 and 72. Consequently, the sliding housing stays in the full displacement position until commanded to move and then responds smoothly and proportionately to a command to decrease the displacement. In alternative embodiments, passageways 92 and/or 94 may be formed in outer housing 50 such that they pass under or over sliding housing 52.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. As such, embodiments described as less desirable than other embodiments or prior art implementations with respect to one or more characteristics are not outside the scope of the disclosure and can be desirable for particular applications.

What is claimed is:

1. A sliding vane pump comprising:

a fixed housing defining inlet and outlet ports;

a sliding housing defining a cylindrical chamber and configured to slide within the fixed housing, the fixed housing and sliding housing defining a side chamber;

a rotor configured to rotate within the cylindrical chamber and having a plurality of vanes configured to seal against a wall of the cylindrical chamber to define a plurality of pumping chambers; and a spring biasing the sliding housing to a position relative to the fixed housing in which a pump displacement is a maximum;

wherein the side chamber is fluidly connected to a first pumping chamber of the plurality of pumping chambers by a first passageway such that fluid pressure in the side chamber exerts a first force on the sliding housing, the first force opposing a second force on the sliding housing due to differential fluid pressures amount the pumping chambers; and wherein the first pumping chamber is fluidly connected to the outlet.

2. The sliding vane pump of claim 1 wherein the first pumping chamber has a first volume less than a volume of any other of the plurality of pumping chambers.

3. The sliding vane pump of claim 1 wherein a second pumping chamber of the plurality of pumping chambers is fluidly connected to the side chamber by a second passageway separate from the first passageway and fluidly connected to the outlet port.

4. The sliding vane pump of claim 3 wherein the second pumping chamber has a second volume greater than a volume of any other of the plurality of pumping chambers.

5. A pump comprising:

a slider defining a cylindrical chamber and configured to slide within a housing;

a rotor configured to rotate within the cylindrical chamber and having a plurality of vanes configured to seal against a wall of the cylindrical chamber to define a plurality of pumping chambers; and a spring biasing the slider to a position relative to the housing in which a pump displacement is a maximum;

wherein the slider and the housing define a side chamber fluidly connected to a subset of the pumping chambers, including a pumping chamber having a minimum volume among the plurality of pumping chambers, by passageways defined in the slider.

6. The pump of claim 5 wherein the side chamber is fluidly connected to a first pumping chamber of the plurality of pumping chambers by a first passageway defined in the slider and fluidly connected to a second pumping chamber of the plurality of pumping chambers by a second passageway defined in the slider.

7. The pump of claim 6 wherein the first pumping chamber has a volume less than volumes of all other pumping chambers in the plurality of the pumping chambers.

8. The pump of claim 7 wherein the second pumping chamber has a volume greater than volumes of all other pumping chambers in the plurality of the pumping chambers.

9. The pump of claim 6 wherein the first and second pumping chambers are fluidly connected to an outlet port defined in the housing.

* * * * *